United States Patent [19]

Williamson et al.

[11] Patent Number: 4,546,835

[45] Date of Patent: Oct. 15, 1985

[54] HORIZONTAL EARTH BORING DIRECTIONAL GUIDE

[76] Inventors: Carlton R. Williamson, 1117 Harrison, Hurst, Tex. 76053; Fred M. Peterson, 3232 Shawnee Trail, Fort Worth, Tex. 76135

[21] Appl. No.: 268,772

[22] Filed: Jun. 1, 1981

[51] Int. Cl.[4] ..... E21B 47/022

[52] U.S. Cl. ..... 175/40; 175/62; 173/20

[58] Field of Search ..... 175/62, 220, 40, 45, 175/53; 33/263, 286; 173/20

[56] References Cited

U.S. PATENT DOCUMENTS

| | | | |
|---|---|---|---|
| 1,310,274 | 7/1919 | Branning | 175/45 |
| 1,932,068 | 10/1933 | Engelbright | 175/62 |
| 2,665,117 | 1/1954 | Ivey | 175/62 |
| 3,651,872 | 3/1972 | Smith, Jr. | 175/53 |
| 3,696,874 | 10/1972 | Brinkman | 175/220 |

*Primary Examiner*—William F. Pate, III

[57] ABSTRACT

Discloses a machine and method for drilling a horizontal bore through earth formation including a directional guide for supporting the rotating drill stem near the bore entrance to cause the drill stem to extend into the drilled bore toward a designated target. The directional guide includes a base member adapted to be supported upon the earth surface across a trench, a first guide sleeve for supporting rotatable drill stem and extending below the base member into the trench through a first riser guide member rigidly connected to the first sleeve and adjustably connected to the base member, adjustment means for connecting the first guide member to the base member to position and to support said first sleeve from said base member at a designated longitudinal distance from said base member and a designated lateral distance and rotational relation with respect to the base member. A second said guide member is mounted apart from the first guide member and adjustably connected by means of a second adjustment means in the same manner as the first guide member. Sighting means may be mounted with the positioning means on the drill stem for aligning the drill stem with the target through adjustment of the adjustment means.

8 Claims, 7 Drawing Figures

FIG. 1
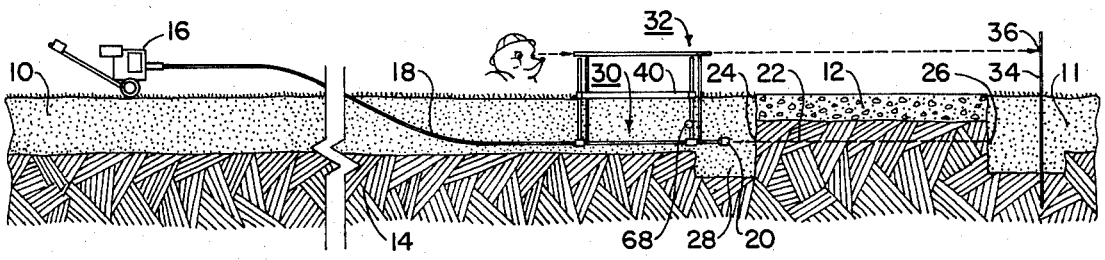
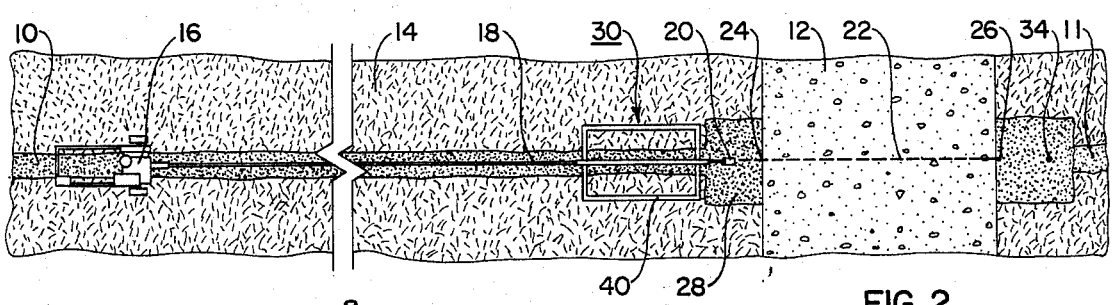
FIG. 2
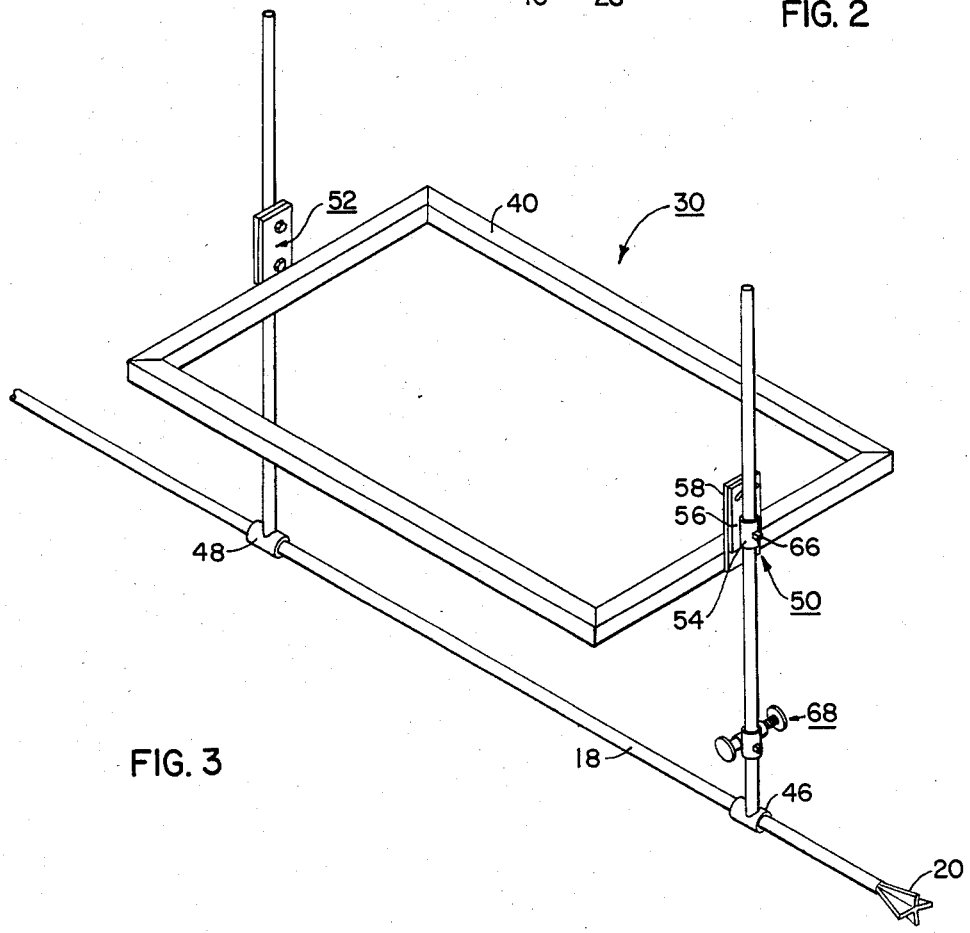
FIG. 3

HORIZONTAL EARTH BORING DIRECTIONAL GUIDE

This invention generally pertains to apparatus for boring horizontal holes or bore in the earth underneath a street, parking lots, and the like, and more particularly pertains to a boring apparatus combination with which the boring drill stem may be aimed at a remote target and thereafter directionally supported while the drill stem is boring a hole towards such target.

BACKGROUND OF THE INVENTION

The earth boring and tunneling arts in general are old, well developed, and extensive. Earth boring machines for boring underneath paving and the like are commercially available.

An exemplary earth boring machine such as described for use in combination with the directional guide of the present invention is provided commercially by Carlton International Manufacturing Company, Hurst, Texas, with the trade name PORTA-MOLE.

OBJECTS OF THE INVENTION

One object of the present invention is to conveniently bore horizontal holes through earth formation to a target destination which may be up to or greater than 150 feet in length, for example.

Another object of the present invention is to bore horizontal holes conveniently and accurately with apparatus which may be used with minimum training of operating personnel.

Yet another object of the present invention is to provide directional guiding apparatus which is relatively simple and inexpensive to manufacture.

SUMMARY OF THE INVENTION

The foregoing and other objects of the invention are attained by the combination including a machine having a drilling bit attached to a drill stem for drilling a horizontal bore through earth formation while circulating drilling fluid through the stem and bit to flush cuttings back along the outside of the drill stem and out of the bore entrance, a directional guide for supporting the rotating drill stem near the bore entrance to cause the drill stem to extend into the drilled bore toward a designated target. The directional guide comprises a base member adapted to extend horizontally across a trench defined in the earth and be supported upon the earth surface, a first guide sleeve for supporting rotatable drill stem and extending below the base member through a first riser guide member which is rigidly connected to the first sleeve and adjustably connected to the base member. Adjustment means are provided for connecting the first guide member to the base member to position and to support said first sleeve from said base member and a designated lateral distance with respect to the connection of said adjustment means to said base member. A second said guide member is adjustably connected by means of a second adjustment means to the base member and a second said guide sleeve for adjustably positioning the second guide sleeve relative to the base member and the second guide sleeve. Sighting means may be mounted with the positioning means or on the drill stem for aligning the drill stem toward the designated target through adjustment of the adjustment means.

BRIEF DESCRIPTION OF THE DRAWING

FIG. 1 is a partly sectional, elevational schematic view of a horizontal earth boring combination of the present invention;

FIG. 2 is a plan view taken from above FIG. 1;

FIG. 3 is a schematic isometric view of the directional guide portion of the combination shown in FIGS. 1 and 2;

DESCRIPTION OF THE PREFERRED EMBODIMENT

Figure 4:
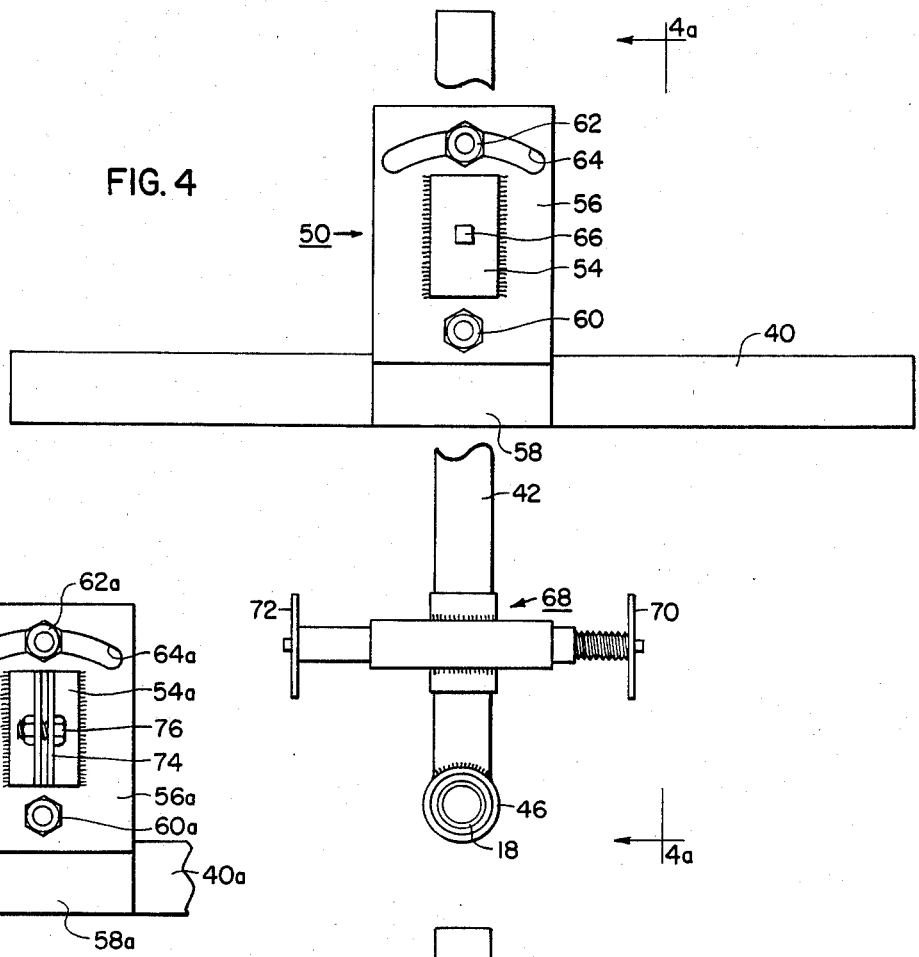
FIG. 4 is a side elevation of the directional guide taken along the line of the trench shown in FIGS. 1 and 2.

Referring now to FIGS. 1 and 2, the cross section of trenches 10 and 11 are seen to extend on either side of a paved surface 12 such as a street, parking lot, or the like, as developed with earth 14. Installed for use in the trench 10 is a horizontal earth boring combination including a boring machine 16 through which is rotated a length of drill stem 18 which terminates in a drill bit 20. The boring machine 16 may be powered by a gasoline engine or the like. The previously mentioned PORTA-MOLE machine has been a guite satisfactory machine in use with the development of the prototype directional guide herein described.

The drill stem 18 is comprised of a plurality of screwed sections which may be added to the drill stem as the drill bit 20 processes further away from the boring machine 16. Alternately, the machine may begin drilling with a designated length of drill stem 18 and the machine moved forward to advance the drill bit 20.

As shown in FIGS. 1 and 2, a planned path 22 is indicated by dashed lines underneath the paving 12 from a starting point 24 in the end face of the trench 12 and ending at an exit point 26 at the beginning of trench 11.

Immediately adjacent the starting point 24 in trench 10 is a sump 28 which has been dug into the bottom of the trench for a purpose later described.

Positioned immediately adjacent the starting point 24 in trench 10 is the lower part of the directional guide apparatus 30 located immediately adjacent the starting point 24 at the end of the trench 10. A section of the drill stem 18 is supported in journalled relation through the guide apparatus 30.

The drill stem 18 guides the direction of the drill bit 24, as the bit is rotated, to cut a bore along the planned path 22 and the drill stem 18 is supported in turn by the guide apparatus 30 to align the axis of the drill stem 18 with the bore path 22 as desired and designated.

As seen in FIG. 1, a sight 32 is supported from two spaced apart positions on the drill stem 18 so that the sight 32 is oriented in alignment with the axis of the drill stem 18 both in elevation and traverse.

A target stake 34 is located and vertically positioned immediately adjacent the exit point 26 in the trench 11 such that a target mark 36 is shown on the target stake at a predescribed distance above exit point 26 with the target mark being at the same elevation and horizontal position as will be seen through the sight 32 when the drill pipe 18 and bit 20 are properly aligned to define a bore through the earth under paving 12 along the line of the bore path 22.

As later described, the guide apparatus 30 is adjusted to adjust the axis of the drill stem 18 to be aligned with the bore path 22.

Referring now to FIGS. 3 and 4 in addition to FIGS. 1 and 2, the guide apparatus 30 is seen to include a base member 40 which rests firmly and solidly upon the earth 14 in a position to straddle the trench 10. Extending down into the trench 10, from spaced apart positions on the base member 40, are riser guide members 42 and 44. Respectively connected to the lower ends of guide members 42 and 44 are guide sleeves 46 and 48 through which the drill stem 18 is journalled in rotatable relation.

The respective positions of the guide sleeves 46 and 48 determine the direction in which the axis of the drill stem 18 and drill bit 20 are aimed into the earth at the starting point 24.

Figure 5:
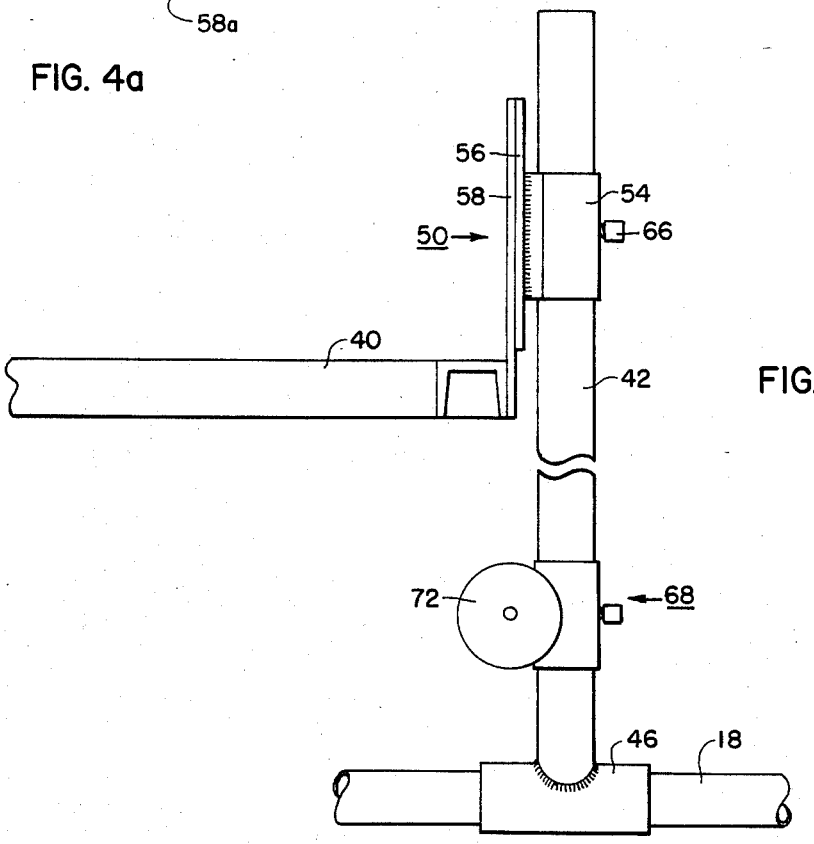
FIG. 5 is a cross sectional view of the apparatus as taken along the line 5—5 of FIG. 4.

As can be seen in FIGS. 3–5, each of the riser guide members 42 and 44 is connected through a respective adjustable supporting mechanism 50 and 52. These adjustable supports 50 and 52 are of the same construction.

As seen in FIGS. 4 and 5, the support mechanism 50 includes a riser sleeve 54 attached, as by welding, to a movable mounting plate bracket 56. The mounting bracket 56 is adjustably attached to a fixed plate bracket 58 which in turn is connected to the base member 40, as by welding.

The mounting bracket 56 is attached at its lower end by a bolt 60 to a bracket 58 in pivoted relationship and at its upper end by a bolt 62 fitted through a hole in the fixed bracket 58 and a slot 64 in the mounting bracket 56.

As seen in FIGS. 4 and 5, the mounting bracket 56 may be mounted at varied angles with respect to fixed bracket 58 and base member 40 within the limits of the length of the slot 64.

Within the riser sleeve 54 is mounted the riser guide member 42 which may be rotated within the sleeve and also moved up and down within the sleeve. As shown in FIG. 4, the riser guide member 42 may be retained and fixed at any rotational and vertical position by means of a set screw or bolt 66.

Though not shown and described in detail, the adjustable support mechanism 52 supports the guide member 44 in the same manner as support member 50 supports the guide member 42.

Also seen in FIGS. 4 and 5 is an adjustable hold down stabilizer or jack 68 which is attached to the riser guide member 42. The hold down 68 is adjustable to be expanded into forceful contact with the walls of the trench 10 and thereby stabilize and hold down the riser guide member 42 against lateral or upward creep while the drill stem 18 is being rotated to advance the bore along the planned path 22.

The hold down stabilizer 68 has screwed shafts at is either end terminating in support plates or washers 70 and 72 which are rotated into forceful contact with the walls of the trench 10 and thereby fix the guide sleeve 46 against vertical and horizontal movement.

Figure 4A:
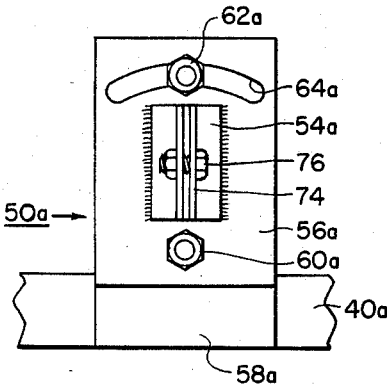
FIG. 4*a* shows an alternate embodiment of a clamping arrangement of the apparatus shown in FIG. 4.

An alternate construction of riser sleeve 54 is shown in FIG. 4*a*. As shown, the riser sleeve 54*a* is of a split sleeve structure having turned out flanges 74 through which a clamping bolt 76 is installed in lieu of the set screw or bolt 68. Either structure is deemed to be satisfactory for the purposes of the directional guide 30 as shown.

OPERATION OF THE PREFERRED EMBODIMENT

In operation of the present invention, the equipment as previously described is installed as shown in FIGS. 1 and 2 with the boring machine 16 set spaced apart from the directional guide apparatus 30 and with the drill stem 18 and bit 20 mounted within the trench 10 through the guide sleeves 46 and 48 as shown. The base member 40 is mounted to be stable with respect to the earth formation 14. The guide sleeve 48 is vertically and laterally adjusted by means of the adjustable support 52 such that the bit 20 is closely positioned with respect to the starting point 24 and the drill stem 18 is generally aligned with the planned path 22.

The guide sleeve 46 is then adjusted by the adjustable support mechanism 50 such that the tube sight 32, as mounted in alignment with the drill pipe 18, is accurately aligned with the target mark 36. The mark 36 has been previously positioned with respect to the exit point 26.

At such time as drill stem 18 is aligned with the planned path 22, the hold down stabilizer 68 is adjusted to stabilize the drill stem 18 against any vertical or lateral creep as may be caused by the stem when the stem is being driven by the boring machine 16.

The drilling operation is then commenced with water being pumped through the drill stem and out the bit 20. As the bit 20 enters the earth formation 14, water is circulated through the bit to wash the cuttings made by the bit back through the annulus and along side the drill stem 18. The cuttings and liquid exit at the starting point 20 into the sump 28. The water in sump 28 is pumped out by means (not shown) in order to maintain trench 10 dry.

As the bit 20 progresses along the planned path 22, additional sections are added to the drill stem 18 at the boring machine 16 as needed. Alternately, the boring machine 16 may be started with the total necessary length of drill stem 18 with the whole assembly of machine and drill stem being then pulled along the general path of trench 10 as the bit 20 advances along the planned path 22.

When using the directional guide 30 as described, the bore drilled along planned path 22 will be completed at or very near the exit point 26, even when hard objects are encountered which may tend to deviate the bit, such as rocks or bricks.

The operator may bore as fast as soil conditions permit, but should never try to force or cram the bit forward. Let the spinning bit do the work. It is safe to bore fast up to the point of lugging the engine.

When boring in some soils that do not readily mix with water, it will be necessary to bore in a few feet (this distance will depend upon the type of soil), back out (cleaning the bore), then go back in. This is called swabbing the bore. When backing out it is not necessary to come out all of the way. The bit may be brought back to within about 6 inches of the bore entrance. This can be determined by a marker painted on the drill pipe back of bit 20, for example.

When swabbing the bore, keep the machine 16 running with the water flowing through the bit 20. Repeat this procedure as many times as is necessary to complete the bore.

In soils that do readily mix and flow with water, it is possible to make a complete bore without swabbing the bore at all. It all depends upon the type of soil, but for best all-around performance it is a good rule of practice never to drill over 30 feet without swabbing the bore.

When the bit reaches the exit point 26, leave the water on. Remove the drill stem 18 from the bore. If a reamer is to be used, stop the machine 16 and turn the water off. Lift out the directional guide 30, bringing the guide members 42 and 44 and the drill stem 18 completely out of trench 10. Lay the guide 30 to either side of the trench and remove the bit 20. Attach a reamer (not shown) and return the guide 30 to its original operating position with the guide arms and drill stem back in the trench. Make sure guide 30 is returned exactly at its original position (in most cases it will leave a track or mark on the ground).

Repeat the boring procedure with the reamer. It will probably be necessary to swab the bore more often when reaming then when boring with a small bit. It may even be necessary to swab the bore in cases where it was not necessary to do so in making the original hole. When reaming a hole, always bring the reamer back to the bore entrance before removing the reamer from th drill stem. This is necessary to insure that the bore is cleaned of all cuttings.

It is very important that the set-up of guide 30 is right because a proper set-up insures a substantially perfect bore. If the set up is not accurate, the results will vary accordingly.

It will be apparent, to those skilled in the art, that various modifications may be made to the embodiment herein disclosed, all within the scope of the following claims.

We claim:

1. In a machine having a drilling bit and drill stem for drilling a horizontal bore through earth formation while circulating drilling fluid through the stem and bit to flush cuttings back along the outside of the drill stem and out of the bore entrance, a directional guide for supporting the rotating drill stem near said bore entrance to cause said drill stem to extend into the drilled bore toward a designated target, said directional guide comprising:

(a) a base member adapted to extend horizontally across an earth trench and to be supported vertically by the earth surface disposed by the sides of said trench;

(b) first guide sleeve means for supporting said drill stem in journalled relation and extending into said trench below the base member from a first riser guide member rigidly connected to said guide sleeve means and adjustably connected to said base member; and (c) first adjustment means for connecting said first riser guide member to said base member to adjustably position and to support said riser guide member including pivotable bracket means connecting and fixing a riser sleeve means at a designated angle with respect to said base member and riser clamping means fixing said riser guide member within said riser sleeve means to position said guide sleeve means at a designated distance and at a designated direction with respect to said base member.

2. The machine of claim 1 further including a second said guide sleeve means positioned apart from said first guide sleeve means and adjustably connected by a second said riser guide member, and a second said adjustment means, to said base member for adjustably positioning said second guide sleeve means relative to said base member and relative to said first guide sleeve means.

3. The machine of claim 1 further including sighting means mountable with said directional guide and with said drill stem for aligning said drill stem through adjustment of said adjustment means toward said designated target.

4. The machine of claim 1 wherein said adjustment means comprises:

(a) a fixed bracket rigidly connected to said base member;

(b) a riser sleeve means adapted to house said riser guide means in journalled relation permitting rotational and longitudinal adjustment of said riser guide member within said riser sleeve means;

(c) a mounting bracket means rigidly connected to said riser sleeve means and adjustably connected in pivot relation with said fixed bracket means;

(d) riser clamping means included with said riser sleeve means for fixing said riser guide means at a designated position with respect to said riser sleeve means; and (e) bracket clamping means for clamping said mounting bracket means to said fixed bracket means at a designated angle with respect to said fixed bracket means.

5. The machine of claim 4 wherein said riser clamping means comprises a set screw threaded through said riser sleeve means into forceful contact against said riser guide member.

6. The machine of claim 4 wherein said riser clamping means comprises clamping flanges included with said riser sleeve means and a bolt to draw said flanges together to pull said riser sleeve means into forceful contact around said riser guide means.

7. The machine of claim 5 wherein said mounting bracket is mounted to said fixed bracket in pivoted relation with bolt means.

8. The machine of claim 1 further including a hold down stabilizer means extendible to the walls of said trench to fix said directional guide, as adjustably positioned with respect to said walls, against movement during rotation of said drill stem.

* * * * *